United States Patent [19]

Hideo

[11] Patent Number: 4,738,179

[45] Date of Patent: Apr. 19, 1988

[54] MUSICAL TONE PRODUCING DEVICE OF WAVESHAPE MEMORY READOUT TYPE

[75] Inventor: Suzuki Hideo, Hamamatsu, Japan

[73] Assignee: Nippon Gakki Seizo Kabushiki Kaisha, Shizuoka, Japan

[21] Appl. No.: 645,254

[22] Filed: Aug. 28, 1984

[30] Foreign Application Priority Data

Sep. 2, 1983 [JP] Japan ..... 58-160429

[51] Int. Cl.[4] ..... G10H 1/12; G10H 1/46; G10H 7/00

[52] U.S. Cl. ..... 84/1.19; 84/1.26; 84/1.27; 84/1.28; 84/DIG. 9

[58] Field of Search ..... 84/1.01, 1.09–1.13, 84/1.19–1.28, DIG. 9

[56] References Cited

U.S. PATENT DOCUMENTS

| | | | |
|---|---|---|---|
| 3,651,730 | 3/1972 | Adachi | 84/1.24 |
| 3,819,844 | 6/1974 | Isii | 84/1.26 |
| 3,965,789 | 6/1976 | Pearlman | 84/1.24 |
| 4,176,577 | 12/1979 | Yamada et al. | 84/DIG. 9 |
| 4,383,462 | 5/1983 | Nagai | 84/1.26 |
| 4,416,178 | 11/1983 | Ishida | 84/1.19 |
| 4,444,082 | 4/1984 | Whitefield | 84/1.21 |
| 4,536,853 | 8/1985 | Kawamoto et al. | 84/1.01 X |
| 4,548,119 | 10/1985 | Wachi et al. | 84/1.19 |
| 4,641,564 | 2/1987 | Okamoto | 84/1.22 |

*Primary Examiner*—S. J. Witkowski

*Attorney, Agent, or Firm*—Spensley Horn Jubas & Lubitz

[57] ABSTRACT

In a typical musical tone producing device of a full waveshape readout type, a full waveshape of a musical tone to be produced from the start to the end of sounding or a rise portion and a part of the waveshape following the rise portion of the musical tone is stored in a waveshape memory, and the musical tone is formed by reading out the waveshape from the waveform memory once, or reading out the rise portion once and thereafter reading out the partial waveshape repeatedly. A digital filter is introduced following the waveshape memory in this tone producing device. The filter characteristics is determined in accordance with a tone color change parameter such as the key touch or the tone pitch of the musical tone, thereby realizing a tone color change of the musical tone. Further, in order to realize timewise change of tone color of the musical tone, the circuit which has the tone color change parameter vary with time is proposed.

27 Claims, 4 Drawing Sheets

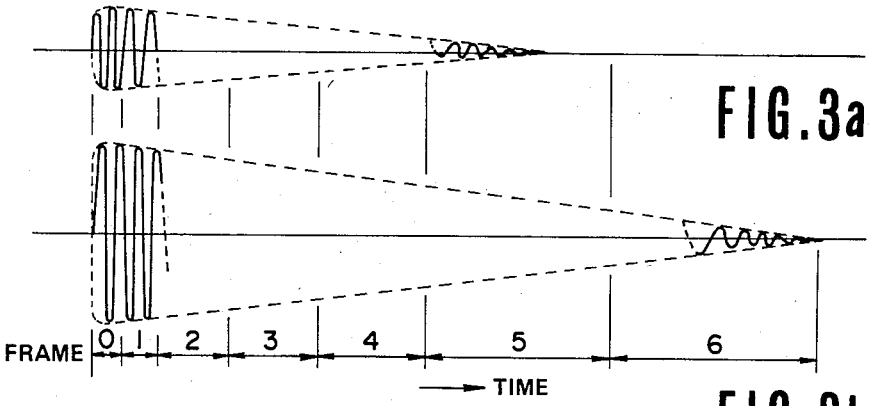
FIG.3a
FIG.3b
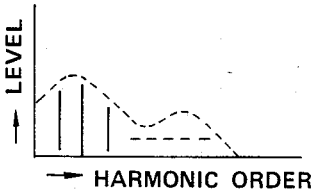
FIG.4a
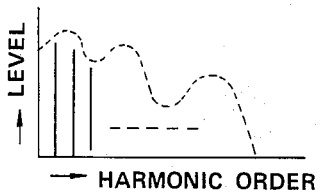
FIG.4b
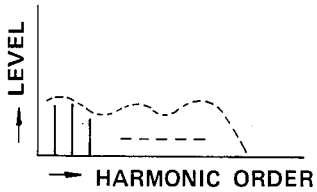
FIG.4c

MUSICAL TONE PRODUCING DEVICE OF WAVESHAPE MEMORY READOUT TYPE

BACKGROUND OF THE INVENTION

This invention relates to a musical tone producing device of a waveshape memory readout type and, more particularly, to a control for realizing a tone color change of a waveshape in accordance with a tone color change parameter such as a key touch or tone pitch read out from a waveshape memory.

It has recently been practiced in the art to store a full waveshape from the start to the end of sounding of the tone or a rise portion and a part of subsequent waveshape portion and, in the case of storing the former, produce a tone of a good quality by once reading out the full waveshape and, in the case of storing the latter, produce a tone of a good quality by reading out a waveshape of a rise portion once and then the part of subsequent waveshape repeatedly.

U.S. Pat. No. 4,383,462 discloses an electronic musical instrument which aims at producing a tone of a high quality by prestoring a full waveshape from rising to termination of sounding of the tone in a memory and reading out the waveshape therefrom. In the waveshape memory WM31 in FIG. 3 of this United States patent, a full waveshape is stored and this full waveshape is read out in response to a signal KD which represents a key depression timing. Such system in which the full waveshape is stored requires a large memory capacity.

In order to improve this point, it has been conceived to store a part of waveshape of plural periods out of the complete sounding period in a waveshape memory and obtain a tone signal by repeatedly reading out the partial waveshape. In the above U.S. Pat. No. 4,383,462, an example of such improvement is shown in FIG. 6. A complete waveshape in the attack period is stored in the waveshape memory WM61 and at least one fundamental period of a tone waveshape is stored in the waveshape memory WM62. An attack waveshape is read out from the memory WM61 in response to the key depression (KD signal) and the tone waveshape of the fundamental period is repeatedly read out from the memory WM62 after completion of the readout of the attack waveshape (IMF signal) until the end of tone generation (DF signal).

If such waveshape memory system is applied without any modification for realizing various tone color change corresponding to tone color change parameters such as the key touch or tone pitch, many different waveshapes in a memory must be prepared in correspondence to all kinds of key touches or tone pitches used. This requires a tremendous memory capacity and therefore is unrealistic.

It is then conceivable to prepare two kinds of continuous waveshapes such, for example, as a continuous waveshape corresponding to the strongest touch and a continuous waveshape corresponding to the weakest touch when key touch strength is used as a tone color change parameter, in a waveshape memory and read out the two waveshapes simultaneously and interpolate them in accordance with the tone color change parameter (i.e., touch strength) thereby producing a new waveshape corresponding to the tone color change parameter (touch strength). In actuality, however, the interpolation would be meaningless unless the two waveshapes to be interpolated were in phase with each other. Since duplicates of waveshapes of tones produced by an actual performance are used as the two types of waveshapes to be prepared in the waveshape memory, the phases of the two waveshapes are very different in general so that the two waveshapes which have been brought in phase with each other at the start point thereof will be greatly out of phase several seconds later. This system, therefore, is also unrealistic.

It is, therefore, an object of the present invention to realize various tone color changes by a relatively small-scale and low cost construction in a musical tone producing device of full waveshape readout type with improved tone quality.

SUMMARY OF THE INVENTION

The present invention provides a musical tone producing device of a type in which a full waveshape of a tone to be produced from the start to the end of sounding or a rise portion and a part of subsequent waveshape of the tone is stored in a waveshape memory, and the full waveshape from the start to the end of sounding of the tone is generated from the memory once, or the rise portion is generated once and thereafter the part of the subsequent waveshape is generated repeatedly, characterized in that a digital filter is introduced and tone color change corresponding to a tone color change parameter such as the key touch or tone pitch of the tone to be generated is realized by changing filter characteristics of the digital filter in accordance with the tone color change parameter.

The filter characteristics of the digital filter can be varied with a considerable degree of freedom by only changing the parameter called "coefficient" without changing the circuit construction. On the other hand, the musical tone producing device employing a waveshape memory storing the full waveshape or the partial waveshape having plural periods as described above can readily obtain a tone of a good quality but its circuit construction tends to become large. The present invention enables a musical tone producing device employing such a waveshape memory to realize various tone color changes corresponding to the key touch or tone pitch without enlarging the circuit construction, by simply adding a digital filter and besides obtain a tone of a good quality capable of such various tone color changes.

It is another feature of the invention to be able to realize a high-fidelity change of a tone color with time by changing the filter characteristics as time elapses. To change the tone color with time is generally troublesome in a musical tone producing device employing the waveshape memory storing a full waveshape or a partial waveshape as described above. According to this invention, however, not only the steady tone color change but the timewise change of the tone color is performed in the musical tone producing device.

More precisely, the second feature of the invention is to divide the full waveshape from the start to the end of sounding into a plurality of frames along a time axis, prepare a filter characteristics parameter independently for each of these frames, and set the filter characteristics of the digital filter independently for the respective frames in accordance with this filter characteristics parameter. The filter characteristics parameter for each frame is determined separately in accordance with the tone color change parameter such as the key touch or the tone pitch of the tone to be generated.

The present invention is applicable to tone color change controls including a touch response control in which the tone color and tone level are controlled in accordance with the key touch strength and a key scaling control in which the tone color and tone level are controlled in accordance with the tone pitch or tone range of a depressed key. Accordingly, the strength of the key touch, the tone pitch or tone range of the depressed key, or other various factors contributing to the tone color change may be utilized as the tone color change parameter.

The filter characteristics parameter corresponding to each tone color change parameter should preferably be determined to have a frequency-amplitude characteristic corresponding to the difference between a spectrum of a waveshape (reference waveshape) prepared in a waveshape memory and a spectrum of a waveshape representing a desired tone color change. By this arrangement, a waveshape of a good quality closely resembling a desired waveshape can be derived from the digital filter. The filter characteristics parameter for each frame can likewise be determined according to the difference in spectrum with respect to each frame.

According to this invention, a waveshape of a good quality read out from a waveshape memory is filter-controlled in accordance with filter characteristics corresponding to a desired tone color change parameter and, accordingly, even if only one kind of waveshape of a good quality is stored in the waveshape memory, a waveshape of the same good quality can be produced on the basis of this stored waveshape with various tone color changes (the tone color changes corresponding to the key touch, the tone pitch of the depressed key, or other various tone color changing factors). The invention therefore can advantageously realize such tone color change of a good quality with a relatively small and low-cost device.

For general theory about the digital filter, detailed description is found in literature such as "Digital Processing of Signals" written by Bernord Gold and Charles M. Rader and "Digital Signal Processing" written by Alan V. Oppenheim and Ronald W. Schafer.

BRIEF DESCRIPTION OF THE DRAWINGS

In the accompanying drawings,

FIG. 3*a* is a diagram showing an example of the full waveshape of a desired waveshape omitting a part thereof;

FIG. 3*b* is a diagram showing an example of the full waveshape of a desired waveshape omitting a part thereof;

FIG. 4*a* is a diagram showing an example of spectra in the waveshape of FIG. 3*a* or in a certain frame of the waveshape of FIG. 3*a;*

FIG. 4*b* is a diagram showing an example of spectra in the waveshape of FIG. 3*b* or in a frame of the waveshape of FIG. 3*b*, which frame corresponds to the frame in FIG. 4*a*;

FIG. 4*c* is a diagram showing spectrum difference between the spectra shown in FIG. 4*a* and that shown in FIG. 4*b;*

DESCRIPTION OF PREFERRED EMBODIMENTS

An embodiment of the present invention will now be described with reference to the accompanying drawings.

Figure 1:
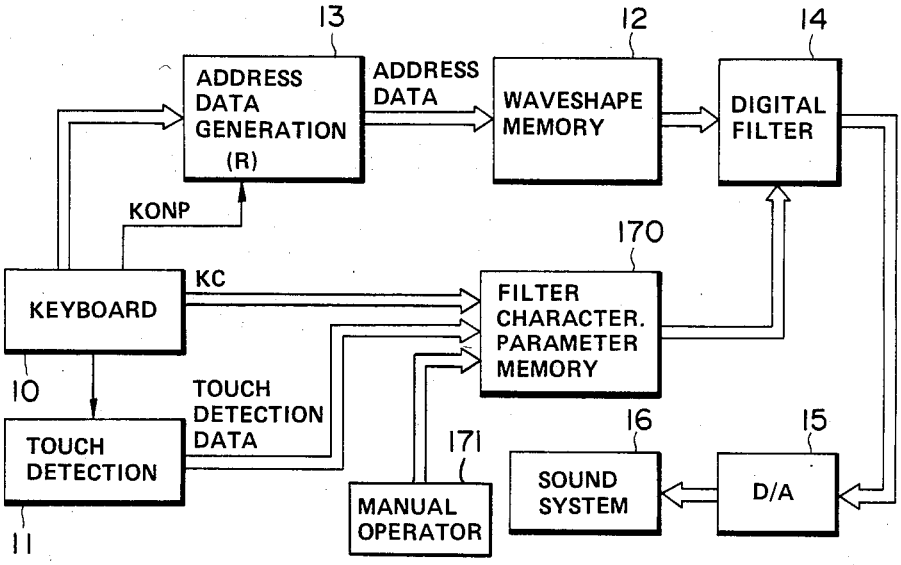
FIG. 1 is an electrical block diagram showing the first embodiment of the present invention.

FIG. 1 shows the first embodiment of the invention. A keyboard 10 is provided as means for designating tone pitch of a tone to be generated. The touch given to a depressed key in the keyboard is detected by a touch detection device 11 and touch detection data is used as a tone color change parameter to produce a tone wavehsape having tone color and level charactersitics corresponding to the degree of the touch. There are various types of touch detection devices among which a type of device detecting the speed of key depression, a type detecting the acceleration of key depression (i.e., a key depressing force) and a type detecting the pressure of key depression are well known. The first type of device is disclosed in U.S. Pat. No. 3,819,844, the second type in U.S. Pat. No. 3,651,730 and the third type in U.S. Pat. No. 3,965,789 respectively and detailed description of these devices will be omitted. A waveshape memory 12 prestores a full waveshape of the rise portion of the tone and/or full waveform subsequent to the rise portion until completion of sounding of the tone (i.e., a full waveshape from the start to the end of sounding of the tone) in correspondence to a certain reference degree of key touch (e.g., the strongest touch). The full waveshape data consists of digital data. An address data generation circuit 13 provided between the keyboard 10 and the waveshape memory 12 supplies to the waveshape memory 12 address data to read out the full waveshape from the start to the end of sounding of the tone from the waveshape memory 12. For example, an address data generated in the address data generation circuit 13 is immediately reset to its initial value in response to a key-on pulse KONP produced upon depression of a certain key on the keyboard, and the address data generated sequentially changes at a rate corresponding to a tone pitch designated by data representing the depressed key. The address data generated by this address data generation circuit 13 is applied to the waveshape memory 12 whereupon the waveshape data stored in the memory 12 is sequentially read out.

The waveshape data read out from the waveshape memory 12 is applied to the digital filter 14 and filtered in accordance with filter characteristics of this filter 14. The output signal of the filter 14 is converted to an analog signal by a digital-to-analog converter 15 and thereafter is supplied to a sound system 16. The filter characteristics of the digital filter 14 are determined by filter characteristic parameters provided in a filter characteristics parameter memory 170.

A filter characteristics parameter memory 170 previously stores filter characteristics parameters which differ from stage to stage of the key touch and a filter characteristics parameter corresponding to touch detection data (i.e., tone color change parameter) corresponding to a detected key touch strength is read out from this memory 170.

The filter characteristics parameter is determined to have a frequency-amplitude characteristic corresponding to the difference between the spectrum of the waveshape (reference waveshape) prepared by the waveshape memory 12 and that of the desired waveshape. Processings made prior to this determination are as follows:

Assume that a desired waveshape (full waveshape from the start to the end of sounding of the tone) corresponding to a certain degree of key touch (designated "touch A", e.g., a relatively weak touch) is as shown in FIG. 3*a* and a reference waveshape to be prepared in the waveshape memory 12 (e.g., the waveshape corresponding to the strongest touch) is as shown in FIG. 3*b*. The example in these figures is a piano tone having a percussive envelope. Such desired waveshape and reference waveshape are obtained by an actual piano performance. The desired waveshape and the reference waveshape are of the same frequency (same pitch).

The following processings "a"–"d" are performed using the waveshapesprepared in this manner:

Processing "a"

Spectrum analysis is performed with respect to the desired waveshape (FIG. 3*a*) and the reference waveshape (FIG. 3*b*). For example, spectrum of the desired waveshape is as shown in FIG. 4*a* whereas spectrum of the reference waveshape is as shown in FIG. 4*b*.

Processing "b"

Difference of the two spectra analyzed in processing "a" is computed, for example, the spectrum difference is as shown in FIG. 4*c*.

Processing "c"

The above described processings "a" and "b" are performed upon changing the degree of key touch of the desired waveshape (i.e., changing to touch B, C, D . . . ) to obtain spectrum difference for the respective touches.

Processing "d"

Filter characteristics parameter determining filter characteristics corresponding to spectrum differences corresponding to the respective touches computed by the processings "b" and "c" are computed.

After completing the above described prior processings, the full waveshape of the reference waveshape is stored in the waveshape memory 12 and filter characteristics parameters corresponding to the respective touches obtained in the processing "d" are stored in the filter characteristics parameter memory 170.

Since the digital filter 14 modifies the reference waveshape in accordance with a filter characteristic parameter corresponding to the spectrum difference between the reference waveshape read out from the waveshape memory 12 and the desired waveshape, a waveshape signal closely resembling the desired waveshape can be obtained.

The tone color change parameter is not limited to the above described key touch strength but the tone pitch (or tone range) of a tone to be produced or an amount of operation of a suitable manual operator may be employed. In this case, filter characteristics parameters corresponding to respective tone pitches (or respective tone ranges) or filter characteristics parameters corresponding to respective amounts of manual operation may be produced in the same manner as the above described processings "a"–"d" and stored in the memory 170. Then, the key code KC representing the depressed key may be applied from the keyboard 10 to the address input of the memory 170 or the output of a tone color change operator may be applied to the address input of the memory 170 and the filter characteristics parameter may be read out from the memory 170 in response to the tone color change parameters such as the key touch strength, tone pitch or amount of manual operation which is applied to the address input of the memory 170.

In the above described first embodiment, the filter characteristics parameter is read out only in accordance with touch detection data functioning as the tone color change parameter and does not undergo a timewise change. In the second embodiment of the invention shown in FIG. 2, firstly, the filter characteristics parameter is caused to change timewise thereby to realize timewise change in the tone color.

Figure 2:
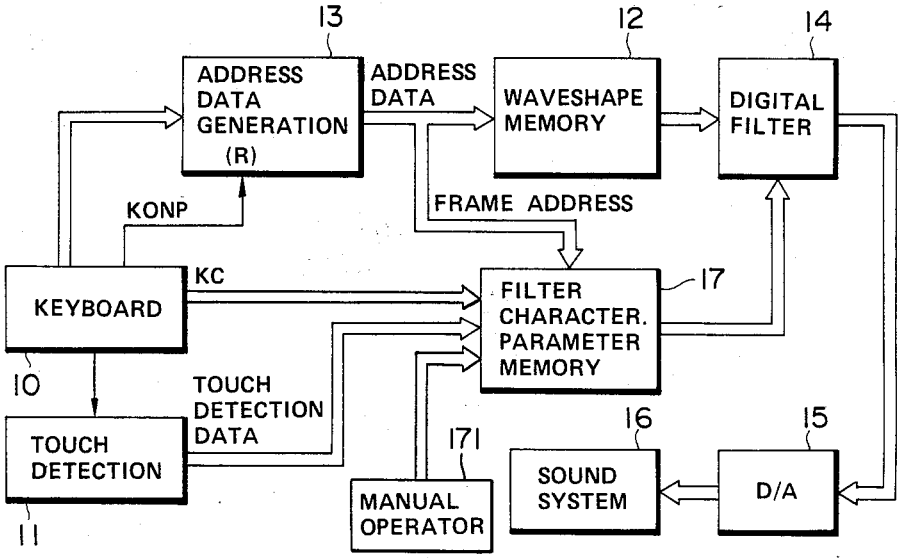
FIG. 2 is an electrical block diagram showing the second embodiment of the present invention.

In FIG. 2, the construction of the filter characteristics parameter memory 17 only is different from the memory 170 of FIG. 1 and the other component parts designated by the same reference characters are of the same construction.

The full waveshape read out from the waveshape memory 12 is divided into a plurality of frames along a time axis. The filter characteristics parameter memory 17 generates filter characteristics parameters frame by frame and supplies them to the digital filter 14. For identifying the frame, a part of the address data generated by the address data generation circuit 13 is utilized as frame address data. The filter characteristics parameter memory 17 prestores a set of filter characteristics parameters corresponding to each frame for each degree of the key touch and a set of filter characteristics parameters is selected in response to touch detection data (i.e., tone color change parameter) provided by the touch detection device 11. Responsive to the frame address data provided by the address generation circuit 13 which functions also as the frame identifying means, a filter characteristics parameter corresponding to one frame is selectively read out of the selected set of parameters and supplied to the digital filter 14.

The filter characteristics parameter for each frame is determined depending upon spectrum difference between the waveshape (reference waveshape) prepared by the waveshape memory 12 and the desired waveshape for the particular frame. Processings made prior to this determination are as follows:

Assume that a desired waveshape (full waveshape from the start to the end of sounding of the tone) corresponding to a certain degree of key touch (designated "touch A", e.g., a relatively weak touch) is as shown in FIG. 3*a* and a reference waveshape to be prepared in the waveshape memory 12 (e.g., the waveshape corresponding to the strongest touch) is as shown in FIG. 3*b*. The example in these figures is a piano tone having a percussive envelope. Such desired waveshape and reference waveshape are obtained by an actual piano performance. The desired waveshape and the reference waveshape are of the same frequency (same pitch). The full waveshape of the reference waveshape which has been prepared in this manner is divided into a plurality of frames (time frames) and the desired waveshape is also divided in correspondence to these frames. This division of frames is not necessarily made in equal time interval but may be of a suitable time interval according to the shape of the waveshape. In the example shown in the figures, the full waveshape is divided in 7 frames of 0–6. Then, the following processings 1–4 are performed:

Processing 1

Spectrum analysis is performed frame by frame with respect to the desired waveshape (FIG. 3*a*) and the reference waveshape (FIG. 3*b*). For example, in frame 0, spectrum of the desired waveshape becomes one as shown in FIG. 4*a* whereas spectrum of the reference waveshape becomes one as shown in FIG. 4*b*.

Processing 2

Difference of the two spectra for the same frame (i.e., the spectrum of the reference waveshape minus the spectrum of the desired spectrum) analized in processing 1 is computed frame by frame. For example, spectrum difference in frame 0 becomes one shown in FIG. 4*c*.

Processing 3

The above described processings 1 and 2 are performed upon changing the degree of key touch of the desired waveshape (i.e., changing to touch B, C, D . . . ) to obtain spectrum difference for each frame for the respective touches.

Processing 4

Filter characteristics parameters determining filter characteristics corresponding to spectrum differences for respective frames corresponding to the respective touches computed by the processings 2 and 3 are computed.

After completing the above described prior processings, the full waveshape of the reference waveshape is stored in the waveshape memory 12 and filter characteristics parameters for the respective frames corresponding to the respective touches obtained in the processing 4 are stored in the filter characteristics parameter memory 17. In this case, different addresses are assigned to respective sample points of the full waveshape data stored in the waveshape memory 12 and different frame addresses are assigned to address groups consisting of plural addresses divided according to the frame division. The address data generation circuit 13 is adapted to produce predetermined frame address in accordance with values of the generated address data. Alternatively, an encoding circuit generating the frame address data in accordance with the value of the address data may be provided separately from the address data generation circuit 13 as the frame identifying means.

Since the digital filter 14 modifies the reference waveshape in accordance with a filter characteristic parameter corresponding to the spectrum difference between the reference waveshape read out from the waveshape memory 12 and the desired waveshape, a waveshape signal closely resembling the desired waveshape can be obtained. This filter characteristics change timewise by frames so that the desired waveshape can be simulated accurately. Determination of the filter characteristic parameter by frames facilitates the operation for determining the parameter.

Figure 5:
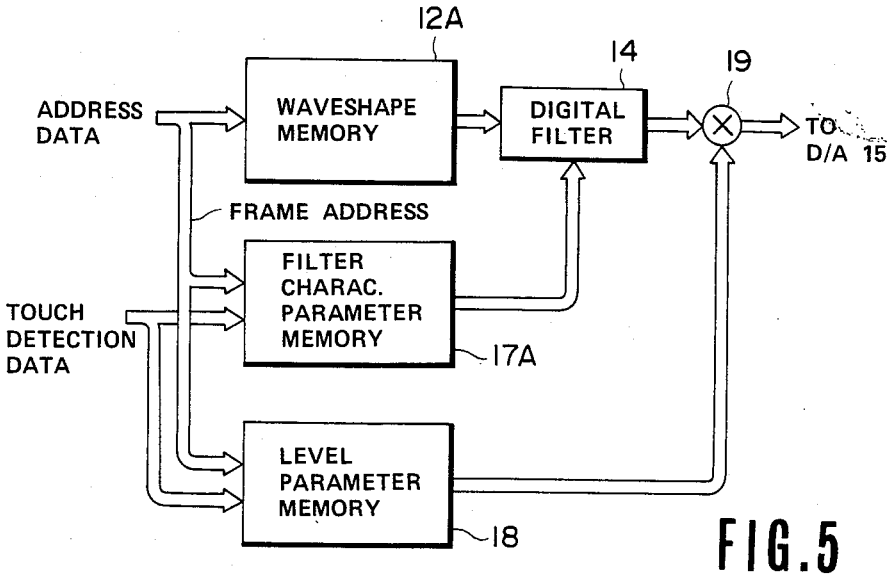
FIG. 5 is an electrical block diagram showing the third embodiment of the invention with respect only to a modified portion in FIG. 2.

FIG. 5 shows the third embodiment of the invention. In the figure, a modified portion in the embodiment of FIG. 2 only is illustrated. In the third embodiment, a level parameter memory 18 is added and the level of the output signal of the digital filter 14 is modified by a multiplier 19 in accordance with a level parameter read out from this memory 18. The level parameter memory 18 stores sets of level parameters for the respective frames prepared for several degrees of touch. In response to the touch detection data provided by the touch detection device 11, a set of level parameters is selected and, in response to the frame address data, a level parameter corresponding to one frame is read out from the selected set. According to this second embodiment, a uniform level control by frames can be made aside from the spectrum control by the digital filter 14 whereby accuracy of reproduction of the desired waveshape is improved.

The third embodiment is particularly effective for achieving the following object:

In the above described second embodiment the reference waveshape and desired waveshape which are subjected to the prior processings 1–4 have actual envelopes as shown in FIGS. 3*a* and 3*b*. For this reason, if touch for the desired waveshape is weak, the amplitude level stays at a relatively low level throughout the full waveshape. Even in the waveshape corresponding to a strong touch such as the reference waveshape, the amplitude level is reduced in the last frame. If the prior processings 1–4 are performed in this small or reduced level of amplitude, width of change of the determined filter characteristics parameter becomes relatively small resulting in a remarkable decrease in accuracy. An attempt to broaden a dynamic range in the data expression of the filter characteristics parameter with a view to improving accuracy under such condition would result in the disadvantage that the number of bits required increases greatly.

Figure 6A:
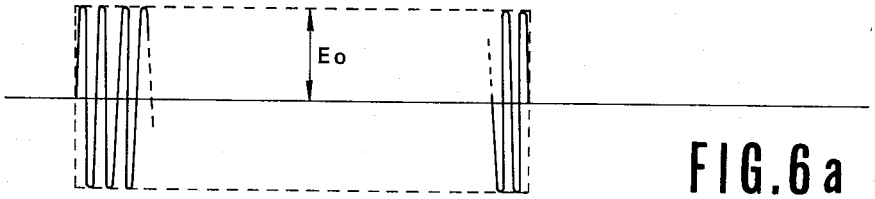
FIG. 6*a* is a diagram showing an example of a waveshape derived by changing the envelope level of the desired waveshape as shown in FIG. 3*a* to a substantially constant level, omitting a part thereof.
Figure 6B:
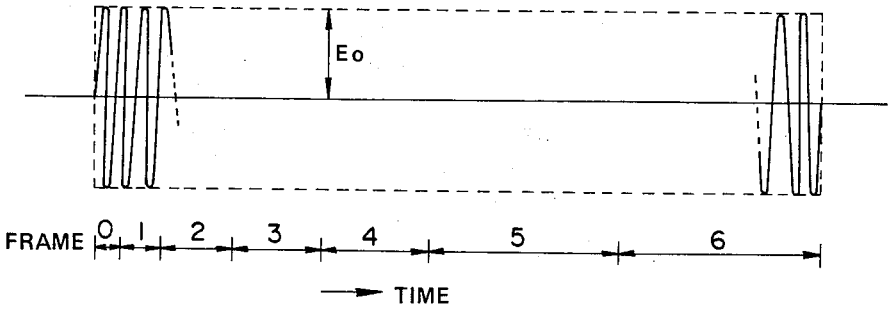
FIG. 6*b* is a diagram showing an example of a waveshape derived by changing the envelope level of the reference waveshape as shown in FIG. 3*b* to a substantially constant level, omitting a part thereof.

In the third embodiment, therefore, waveshapes having envelopes of a substantially constant level $E_O$ are employed as the desired waveshape and reference waveshape as shown in FIGS. 6*a* and 6*b*. FIG. 6*a* shows a waveshape derived by changing the amplitude level of the desired waveshape as shown in FIG. 3*a* corresponding to the desired touch to the predetermined level $E_O$ without changing the waveshape of each period. FIG. 6*b* likewise shows a waveshape derived by changing the amplitude level of the reference waveshape as shown in FIG. 3*b* corresponding to the reference touch to the predetermined level $E_O$ without changing the waveshape of each period. Instead of changing the amplitude level to the constant level $E_O$ at each period, waveshapes of a constant level envelope simulating those of FIGS. 6*a* and 6*b* may be obtained by multiplying the ratio of an average level to the level $E_O$ for each frame of the waveshapes shown in FIGS. 3*a* and 3*b*. The maximum amplitude level of the strongest touch may preferably be chosen as the constant level $E_O$.

In the foregoing manner, the envelope levels of the reference waveshape and the desired waveshape which are subjected to the prior processings 1–4 are changed to substantially constant level $E_O$ and the same processings as the prior processings 1–4 are performed with respect to the changed waveshapes to obtain filter characteristics parameters for the respective frames corresponding to the respective degrees of touch. Since the filter characteristics parameters thus obtained have been derived with respect to the maximum amplitude level, there arise no such problems as the above described decrease in accuracy due to reduction in the amplitude level or undue increase in the number of data bits.

In the third embodiment, the following prior processings 5–7 are performed after the above processings 1–4:

Processing 5

The average level for each frame is computed with respect to the desired waveshape shown in FIG. 3*a*.

Processing 6

Difference between the average level for each frame of the desired waveshape computed in the processing 5 and the average level for each frame of the desired waveshape whose level has been changed to the constant level $E_O$ as shown in FIG. 6*a* (substantially $E_O$ in any frame) is computed.

Processing 7

The processings 5 and 6 are performed upon changing the degree of key touch of the desired waveshape to obtain the level differences for respective frames corresponding to the respective touches.

Data corresponding to the previously obtained level differences for the respective frames corresponding to the respective degrees of touch is stored in the level parameter memory 18 as the level parameter. The reference waveshape having the envelope changed to the substantially constant level $E_O$ as shown in FIG. 6*b* is stored in the waveshape memory 12A. Filter characteristics parameter obtained on the basis of the reference waveshape whose level has been changed to the substantially constant level $E_O$ as described above and the desired waveshape is stored in the filter characteristic parameter memory 17A. By this construction, a waveshape signal simulating the desired waveshape whose envelope has been changed to the constant level $E_O$ as shown in FIG. 6*a* is provided by the digital filter 14 and a waveshape simulating the desired waveshape as shown in FIG. 3*a* is provided by the multiplier 19. Since this third embodiment is capable of accurately determining the filter characteristics parameter with a relatively small number of bits, reliability of the filter control is improved and the spectrum construction of the desired waveshape can be accurately reproduced. The multiplier 19 may be provided on the input side of the digital filter 14. Addition and subtraction may be made instead of the multiplication.

Figure 7:
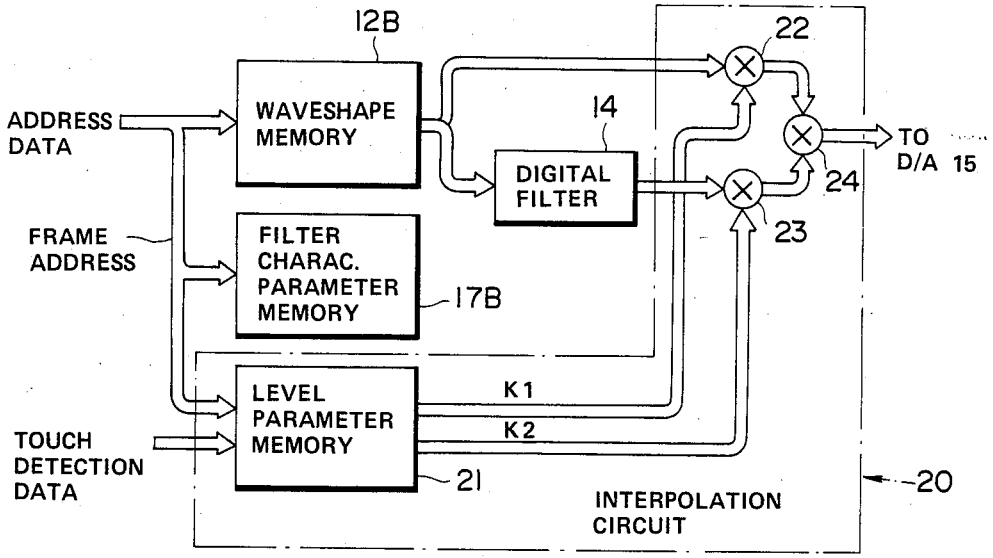
FIG. 7 is an electrical block diagram showing the fourth embodiment of the invention with respect only to the modified portion in FIG. 2.

FIG. 7 shows the fourth embodiment of the invention with respect only to the modified portions in the embodiments shown in FIG. 2 or 5. In the fourth embodiment, interpolation means 20 is added. By interpolating the output of the waveshape memory 12B and the output of the digital filter 14 at a ratio corresponding to the degree of key touch (i.e., tone color change parameter), tone color change corresponding to the key touch is realized.

The waveshape memory 12B stores a waveshape corresponding to the strongest touch. The filter characteristics parameter memory 17B stores only a set of filter characteristics parameters obtained by performing the above described processings 1, 2 and 4 using the waveshape corresponding to the strongest touch as the reference waveshape and the waveshape corresponding to the weakest touch as the desired waveshape. This memory 17B is accessed by the frame address data so that the waveshape corresponding to the weakest touch is produced by the digital filter 14.

The interpolation circuit 20 interpolates the gap between the waveshape corresponding to the strongest touch read out from the waveshape memory 12B and the waveshape corresponding to the weakest touch provided by the digital filter 14 at a rate corresponding to the touch detection data thereby producing new waveshapes corresponding to respective degrees of touch. Since the waveshape corresponding to the weakest touch, which is one of the waveshapes to be subject to the interpolation, is produced by filtering the output of the waveshape memory 12B which is the other waveshape subject to the interpolation, so that the two waveshapes subject to the interpolation are substantially in phase with each other. Accordingly, this fourth embodiment can advantageously introduce the interpolation techniques.

Figure 8:
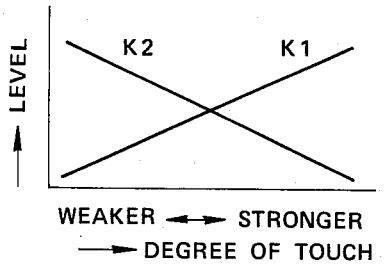
FIG. 8 is a diagram showing an example of an interpolation function corresponding to the degree of key touch stored in a level parameter memory of FIG. 7.

The interpolation means 20 comprises a level parameter memory 21, a multiplier 22 for multiplying a first level parameter k1 read out from this memory 21 with the output signal of the waveshape memory 12B, a multiplier 23 for multiplying a second level parameter k2 read out from the memory 21 with the output of the digital filter 14 and an adder 24 adding the outputs of the multipliers 22 and 23. The level parameter memor 21 basically stores the level parameters k1 and k2 which are of characteristics, as shown in FIG. 8, which change in opposite directions with the degree of touch and produces the level parameters k1 and k2 corresponding to the degree of touch indicated by the touch detection data. Accordingly, the weaker the touch, the smaller the value of the first level parameter k1 and the larger the value of the second level parameter k2 so that the waveshape corresponding to the weakest touch provided by the digital filter 14 and the waveshape corresponding to the strongest touch provided by the memory 12B are combined together at a ratio in which the content of the former is higher than the content of the latter. Conversely, the stronger the touch, the larger the value of k1 and the smaller the value of k2 so that the waveshape corresponding to the strongest touch (output of the memory 12B) and the waveshape corresponding to the weakest touch (output of the filter 14) are combined together at a ratio in which the content of the former is higher than the content of the latter. As a result, interpolation corresponding to the degree of touch is performed.

Data to be stored in the waveshape memory 12B and the filter characteristics parameter memory 17B may be either one determined according to the second embodiment or one determined according to the third embodiment. In a case where the data is one determined according to the second embodiment, the waveshape memory 12B produces a strongest touch corresponding waveshape having a predetermined envelope which changes with time (see FIG. 3*b*) and the digital filter 14 produces a weakest touch corresponding waveshape signal having a predetermined envelope which changes with time (see FIG. 3*a*). In this case, the level parameter memory 21 may produce level parameters k1 and k2 having the above described interpolation function.

Figure 9:
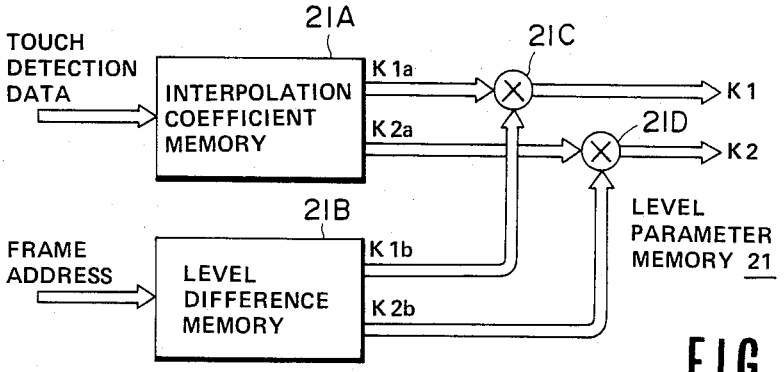
FIG. 9 is an electrical block diagram showing a modified example of the level parameter memor of FIG. 7.

In a case where data to be stored in the waveshape memory 12B and the filter characteristics parameter memory 17B is one determined according to the above described third embodiment, the level parameters k1 and k2 to be generated by the level parameter memory 21 must have not only the interpolation function but also a level modifying function similar to the level parameter used in the third embodiment. In this case, the waveshape memory 12B produces a strongest touch corresponding waveshape whose envelope level has been changed to the substantially constant level $E_O$ as shown in FIG. 6*b* and the digital filter 14 produces a weakest touch corresponding waveshape signal whose envelope level has been changed to the substantially constant level $E_0$ as shown in FIG. 6*a*. The level parameter k1 and k2 which have both the interpolation function and th level modifying function are determined in the following manner. First, with respect to the first level parameter k1, an average level for each frame of the reference waveshape (the strongest touch corresponding waveshape) as shown in FIG. 3*b* is computed and then the difference between this average level and an average level for each frame of the reference waveshape which has been changed to the constant level $E_O$ as shown in FIG. 6*b* (substantially $E_O$ for any frame) is computed, the interpolation function K1 as shown in FIG. 8 is corrected in accordance with the level differences for the respective frames thus computed and finally the first parameter k1 for which the degree of touch and the frame number are used as variables is obtained. With respect to the second level parameter k2, an average level for each frame of the weakest touch corresponding waveshape as shown in FIG. 3*a* is computed, the difference between this average level and an average level for each frame of the weakest touch corresponding waveshape which has been changed to the constant level $E_O$ as shown in FIG. 6*a* (substantially constant level $E_O$ for any frame) is computed, the interpolation function K2 as shown in FIG. 8 is corrected in accordance with the level differences for the respective frames and finally the second level parameter k2 for which the degree of touch and the frame number are used as variables is obtained. The level parameters k1 and k2 obtained in the above described manner are stored in the level parameter memory 21 and read out therefrom in response to the frame address data and the touch detection data. In this case, instead of constituting the level parameter memory 21 with a single memory, the memory 21 may be divided, as shown in FIG. 9, into an interpolation coefficient memory 21A which is accessed in response to the touch detection data and a level difference memory 21B which is accessed in response to the frame address data, the first level parameter k1 may be produced by multiplying, in a multiplier 21*c*, interpolation coefficient data k1*a* corresponding to the strongest touch read out from the memory 21A with level difference data k1b read out from the memory 21B, and the second level parameter k2 may be produced by multiplying, in a multiplier 21D, interpolation coefficient k2'a corresponding to the weakest touch with level difference data k2*b*. The interpolation functions as shown in FIG. 8 are stored in the interpolation memory 21A and data representing level differences for the respective frames corresponding to the strongest and weakest touches determined in the above described manner is stored in the level difference memory 21B.

The third and fourth embodiments are also applicable to the first embodiment. In this case, the frame address data are not applied to the memories 17A, 17B, 18 and 21 in FIGS. 5 and 7.

In the above described embodiments, the waveshape memories 12, 12A and 12B store a full waveshape from the start to the end of sounding of a tone. Alternatively, these memories may store a complete waveshape of the rise portion and a certain part of the remaining portion following the rise portion. In this latter case, the address data generation circuit 13 is adapted such that it generates the complete waveshape of the rise portion immediately upon generation of the key-on pulse KONP and thereafter generates the partial waveshape (also plural periods) repeatedly. An amplitude envelope of the repeatedly read out waveshape signal is imparted by separate envelope imparting means (not shown).

In the second and third embodiments, the filter characteristics parameter memories 17 and 17A individually store filter characteristics parameters for the respective frames in response to respective degrees of touch. Alternatively, these memories may prestore only filter characteristics parameters corresponding to the strongest and weakest touches and read out these parameters simultaneously in response to the frame address, and an interpolation operation corresponding to the touch detection data may be performed utilizing the read out parameters thereby to produce filter characteristics parameters corresponding to the respective degrees of touch by interpolation operations performed for the respective degrees of touch.

In a case where key scaling of the tone color is to be performed using the tone color change parameter as the tone pitch or tone range of the depressed key, this can be carried out in the same manner as in the above described embodiments if the degree of key touch or touch detection data in these embodiments is replaced by the tone pitch or tone range of the depressed key. It is also within the scope of the present invention by utilizing wellknown DPCM (Differential Pulse Code Modulation), ADPCM (Adaptive Differential Pulse Code Modulation), DM (Delta Modulation) or ADM (Adaptive Delta Modulation) technique to have the waveshape memory waveshape data representing the difference between adjacent sample amplitude values and cumulatively add or subtract this difference data in reading thereof from the waveshape memory to obtain the original sample amplitude data.

The foregoing embodiment is one in which the present invention is applied to a keyboard instrument. The present invention is not limited to this but is applicable also to an instrument in which the pitch of generated tones is constant such, for example, as a percussion sound generation device. In this case, the digital filter may be controlled with the strength of percussion being utilized as a tone color change parameter for changing the tone color.

Storing of the waveshape into the waveshape memory according to the present invention may be made also by the method disclosed in U.S. Pat. No. 4,444,082. According to this disclosed method, waveshapes of one period are picked up at several locations in an actual tone waveshape spaced away from one another and these waveshapes and difference waveshapes between the respective waveshapes are stored. A musical tone between the picked up waveshapes is synthesized by adding corresponding difference waveshapes to the picked up waveshapes while causing its level to increase as time elapses.

What is claimed is:

1. A musical tone producing device of a waveshape memory readout type comprising:

waveshape memory means for storing, in digital format, waveshape data constituting a specified portion of a full waveshape of a tone from the start to the end of sounding of a musical tone, said specified portion being a portion having a continuous plural periods of said musical tone and the tone color of said specified portion varying with time;

pitch designation means for designating a pitch of said musical tone;

readout means connected to said pitch designating means and said waveshape memory means for reading out said waveshape data from said waveshape memory means at a rate corresponding to the designated pitch;

change degree designating means for designating a degree of change of tone color of said musical tone;

filter parameter generating means connected to said change degree designating means for generating a filter parameter corresponding to the designated degree of change of tone color;

a digital filter mean connected to said waveshape memory means and said filter parameter generating means and receiving said waveshape data and said filter parameter for modifying said waveshape data in accordance with a filter characteristic determined by said filter parameter and for outputting the modified waveshape data; and tone producing means connected to said digital filter means for producing said musical tone in accordance with said modified waveshape data.

2. A musical tone producing device as defined in claim 1 wherein said waveshape data comprises a plurality of frame waveshape data, each of said frame waveshape data corresponding to each of divided waveshapes belonging to a plurality of frames into which said specified portion is divided;

said readout means further supplies to said filter parameter generating means frame information whose value varies with time and which identifies said plurality of frames and reads out one corresponding to said frame information among said plurality of frame waveshape data;

said filter parameter comprises a plurality of frame filter parameters which correspond to said plurality of frames respectively; and wherein said filter parameter generating means generates one corresponding to said frame information among said plurality of frame filter parameters.

3. A musical tone producing device as defined in claim 2 wherein each of said frame filter parameters corresponds to the difference between the spectrum of one corresponding to said frame information among said divided waveshapes and that of a part corresponding said frame information among a modified waveshape represented by said modified waveshape data.

4. A musical tone producing device as defined in claim 1 which further comprises:

level parameter generation means connected to said change degree designating means for generating a level parameter corresponding to said designated degree of change of tone color; and level modifying means for modifying an amplitude level of a modified waveshape represented by said modified waveshape data in accordance with said level parameter.

5. A musical tone producing device as defined in claim 2 which further comprises:

level parameter generation means connected to said readout means and said change degree designating means for generating one corresponding to said frame information among a plurality of frame level parameters corresponding to said plurality of frames respectively, the generated one being in accordance with said designated degree of change of tone color; and level modifying means for modifying an amplitude level of a part corresponding to said frame information among said modified waveshape in accordance with the generated frame level parameter.

6. A musical tone producing device as defined in claim 5 wherein the amplitude of said specified portion is in advance set so as to be substantially constant over said plurality of frames.

7. A musical tone producing device as defined in claim 1 wherein said filter parameter always corresponds to a predetermined maximum degree of change of tone color, and which further comprises interpolation means provided between, said waveshape memory means and said said digital filter means, and said tone producing means; connected to said change degree designating means; and receiving said waveshape data and said modified waveshape data for interpolating said specified portion and a modified waveshape represented by said modified waveshape in accordance with said designated degree of change of tone color and for outputting a new waveshape data, said tone producing means producing said musical tone in accordance with said new waveshape data.

8. A musical tone producing device as defined in claim 2 wherein each of said frame filter parameters always corresponds to a predetermined maximum degree of change of tone color, and which further comprises:

interpolation means provided between, said waveshape memory means and digital filter means, and said tone producing means; connected to said readout means and said change degree designating means; and receiving said frame waveshape data said modified waveshape data and said frame information; for interpolating one corresponding to said frame information among said plurality of frame waveshapes and a part corresponding to said frame information among a modified waveshape represented by said modified waveshape data in accordance with said degree of change of tone color and for outputting a new waveshape data, said tone producing means producing said musical tone in accordance with said new waveshape data.

9. A musical tone producing device as defined in claim 1 wherein said pitch designation means comprises keyboard means having a plurality of keys which correspond to different pitches respectively.

10. A musical tone producing device as defined in claim 1 wherein said specified portion is equal to said full waveshape.

11. A musical tone producing device as defined in claim 1 wherein said specified portion is an attack portion of said full waveshape.

12. A musical tone producing device as defined in claim 1 wherein said change degree designating means is a manual operator, said designated degree of change of tone color corresponding to the amount of operation of said manual operator.

13. A musical tone producing device as defined in claim 1 wherein said pitch designation means is a keyboard's key designating a pitch of said musical tone, and wherein said change degree designating means designates said degree of change of tone color in correspondence with the pitch designated by said pitch designation means.

14. A musical tone producing device as defined in claim 1 which further comprises a keyboard means having a key; and touch detecting means for detecting the strength of a key touch; and wherein said change degree designating means is said key, said degree of change of tone color corresponding to the detected strength of the key touch.

15. A musical tone producing device as defined in claim 14 wherein said strength of the key touch corresponds to the speed of the key depression.

16. A musical tone producing a device as defined in claim 14 wherein said strength of the key touch corresponds to the pressure of the key depression.

17. A musical tone producing device as defined in claim 14 wherein said strength of the key touch corresponds to the acceleration of the key depression.

18. A musical tone producing device of a waveshape memory readout type comprising:

waveshape memory means for storing, in digital format, waveshape data constituting a specified portion of a full waveshape of a tone, said specified portion being a portion having continuous plural periods of said musical tone and the tone color of said specified portion varying with time;

pitch designation means for designating a pitch of said musical tone;

readout means connected to said pitch designating means and said waveshape memory means for reading out said waveshape data from said waveshape memory means at a rate corresponding to the designated pitch;

change degree designating means for designating a degree of change of tone color;

filter parameter generating means connected to said change degree designating means for generating a filter parameter corresponding to the designated degree of change of tone color;

a digital filter means connected to said waveshape memory means and said filter parameter generating means and receiving said waveshape data and said filter parameter for modifying said waveshape data in accordance with a filter parameter characteristic determined by said filter parameter and for outputting the modified data;

tone producing means connected to said digital filter means for producing said musical tone in accordance with said modified waveshape data; and wherein.

said filter parameter corresponds to the difference between the spectrum of said specified portion and the spectrum of a desired musical tone having the modified waveshape represented by said modified waveshape data.

19. A musical tone producing device according to claim 18 wherein said spectrum difference includes spectrum modification other than cut-off frequency.

20. A musical tone producing device according to claim 18 wherein said pitch designating means comprises a keyboard having keys for pitch selection, wherein said change degree designating means comprises one or more touch sensors associated with said keyboard, and wherein said stored waveshape data represents the waveshape of a musical tone having a reference spectrum corresponding to the strongest touch response sensed by said touch sensors, and wherein said filter parameter generating means generates different sets of filter parameters corresponding respectively to different touch response levels sensed by said touch sensors.

21. A musical tone producing device of a waveshape memory readout type comprising:

waveshape memory means for storing, in digital format, waveshape data constituting a specified portion of a full waveshape of a tone from the start to the end of sounding of a musical tone, said specified portion having continuous plural periods of said musical tone;

pitch designation means for designating a pitch of said musical tone;

readout means connected to said pitch designating means and said waveshape memory means for reading out said waveshape data from said waveshape memory means at a rate corresponding to the designated pitch;

change degree designating means for designating a degree of change of tone color of said musical tone;

filter parameter generating means connectd to said change degree designating means for generating a filter parameter corresponding to the designated degree of change of tone color, said filter parameter corresponding to the difference between the spectrum of said stored specified portion of said full waveshape and the spectrum of a desired musical tone waveshape having said designated degree of change of tone color;

a digital filter means connected to said waveshape memory means and said filter parameter generating means and receiving said waveshape data and said filter parameter for modifying said waveshape data in accordance with a filter characteristics determined by said filter parameter and for outputting waveshape data corresponding to said desired musical tone waveshape; and tone producing means connected to said digital filter means for producing said musical tone in accordance with said modified waveshape data.

22. A musical tone producing device as defined in claim 21 wherein said filter parameter generating means stores in advance a plurality of different filter parameters corresponding to different degrees of change of tone color, wherein said generating means generates for use by said digital filter means, that one digital filter parameter set specified by said change degree designating means.

23. An electronic musical instrument comprising:

a waveshape memory storing data representing a specified portion of a full waveshape of a musical tone, said portion of a full waveshape having plural periods and having a reference spectrum, a filter characteristic parameter memory storing plural sets of digital filter characteristic parameters, each set of filter characteristic parameters representing the difference spectrum between said reference spectrum and the spectrum of a desired musical tone waveshape, readout means for reading out said stored portion of said full waveshape from said memory at a rate that establishes the tone pitch of a generated musical tone, and digital filter means for digitally filtering the read out full waveshape data utilizing a selected set of said digital filter characteristic parameters from said parameter memory, thereby to produce a musical tone having said rate-established pitch and having the spectrum of said associated desired musical tone waveshape.

24. A method for musical tone production comprising the steps of:

storing data of a musical tone waveshape constituting a specified portion of a full waveshape of a tone from the start to the end of sounding of said musical tone, said specified portion including plural periods, computing in advance a difference spectrum representing the difference between the spectrum of said stored musical waveshape and the spectrum of a desired musical tone waveshape, computing digital filter parameters corresponding to the computer difference spectrum and storing said computed digital filter parameters, and producing a musical tone by reading out in real time said musical waveshape data and digitally filtering said read out stored musical waveshape data utilizing said computer and stored filter parameters, thereby to produce said desired musical tone waveshape.

25. A method according to claim 24 wherein said stored musical tone waveshape is divided into frame portions, wherein said steps of computing said difference spectrum, computing said filter parameters and storing said computed filter parameters are carried out separately for each of said frames, and wherein during said producing step the respective stored filter parameters are utilized for digitally filtering the corresponding frames read out musical waveshape data.

26. A musical tone producing device of a waveshape memory readout type comprising:

waveshape memory means for storing, in digital format, waveshape data constituting a specified portion of a full waveshape of a tone from the start to the end of sounding of a musical tone, wherein said specified portion has plural periods of said musical tone and the tone color of said specified portion varies with time;

address data generating means for generating address data whose value varies with time at a rate corresponding to a pitch of a musical tone to be produced;

readout means connected to said address data generating means and said waveshape memory means for reading out said waveshape data from said waveshape memory means in response to said address data;

filter parameter generating means for generating a filter parameter which varies over time;

a digital filter means, connected to said waveshape memory means and said filter parameter generating means and receiving said waveshape data and said filter parameter, for modifying said waveshape data in accordance with a filter characteristic determined by said filter parameter and for outputting the modifed waveshape data; and tone producing means connected to said digital filter means for producing said musical tone to be produced in accordance with said modified waveshape data so that the tone color of said specified portion further varies over time in accordance with the varying filter parameter.

27. A musical tone producing device of a waveshape memory readout type comprising:

waveshape memory means for storing, in digital format, waveshape data constituting a specified portion, including at least an attack portion, of a full tone waveshape from the start to the end of sounding of a musical tone, said specified portion being a portion having plural periods of said musical tone, wherein the tone color of said specified portion varies with time and the envelope amplitude level of said specified portion is substantially constant;

readout means connected to said waveshape memory means for reading out said waveshape data from said waveshape memory means at a rate corresponding to a pitch of a musical tone to be produced;

level information generating means for generating level information in response to a signal representative of the start of said musical tone; and level control means connected to said level information generating means for modifying said waveshape data in accordance with said level information so that the amplitude level of said specified portion varies in response to said level information.

* * * * *

UNITED STATES PATENT AND TRADEMARK OFFICE

CERTIFICATE OF CORRECTION

PATENT NO. : 4,738,179

DATED : April 19, 1988

INVENTOR(S) : Hideo Suzuki

It is certified that error appears in the above-identified patent and that said Letters Patent is hereby corrected as shown below:

On the title page inventor should read

--(75) Inventor: Hideo Suzuki --

Item (19) under United States Patent, "Hideo" should read -- Suzuki --.

Signed and Sealed this

Thirtieth Day of August, 1988

*Attest:*

DONALD J. QUIGG

*Attesting Officer*

*Commissioner of Patents and Trademarks*